United States Patent [19]

Evans

[11] 4,269,191

[45] May 26, 1981

[54] MASTECTOMY BRA

[76] Inventor: Annette Evans, 16 Lightsey La., Lutz, Fla. 33549

[21] Appl. No.: 57,846

[22] Filed: Jul. 16, 1979

[51] Int. Cl.[3] ..... A41G 3/00

[52] U.S. Cl. ..... 128/488; 128/510

[58] Field of Search ..... 128/488, 510, 481, 504, 128/505, 479, 509; 3/36

[56] References Cited

U.S. PATENT DOCUMENTS

| | | | |
|---|---|---|---|
| 3,094,125 | 6/1963 | Lewis | 128/488 |
| 3,196,878 | 7/1965 | Hedu | 128/472 |
| 3,465,754 | 9/1969 | Lockwood et al. | 128/488 |
| 3,478,739 | 11/1969 | Librande | 128/482 |

FOREIGN PATENT DOCUMENTS

| | | | |
|---|---|---|---|
| 604263 | 1/1926 | France | 128/509 |
| 720593 | 12/1931 | France | 128/509 |

*Primary Examiner*—Doris L. Troutman

*Attorney, Agent, or Firm*—Stein & Frijouf

[57] ABSTRACT

The invention comprises an improved mastectomy bra specifically adapted for a female having a single mastectomy. The bra comprises a left and a right bra element, each being an independent and separate article. Each of the left and right bra elements comprises a bra cup and a chest band secured to the bra cup for encircling the chest of the female. A bra clasp is diposed in at least one of the chest bands enabling one of the bra elements to be completely removed to expose the breast of the female while simultaneously enabling the other of the bra elements to remain in place to cover the prosthesis of the female.

5 Claims, 6 Drawing Figures

FIG. 1
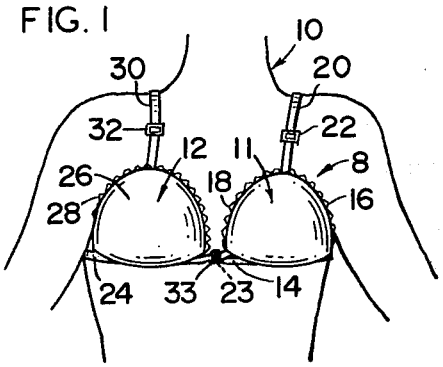
FIG. 2
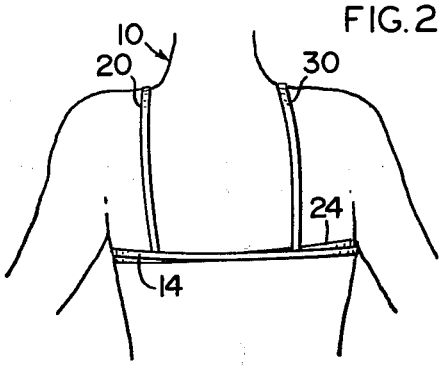
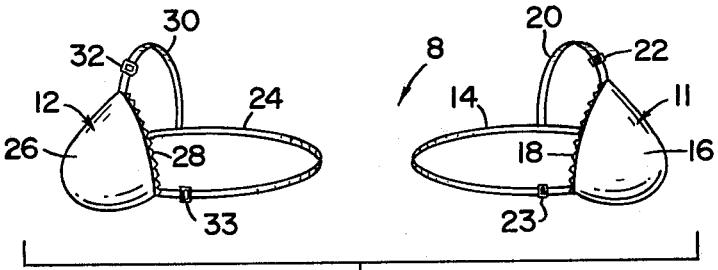
FIG. 3
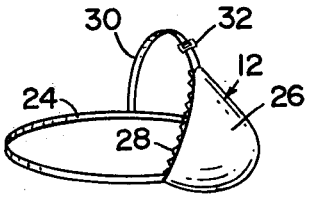
FIG. 4
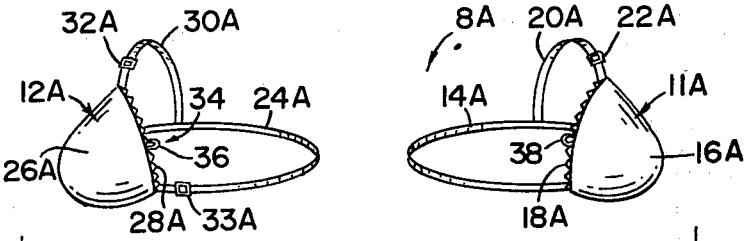
FIG. 5
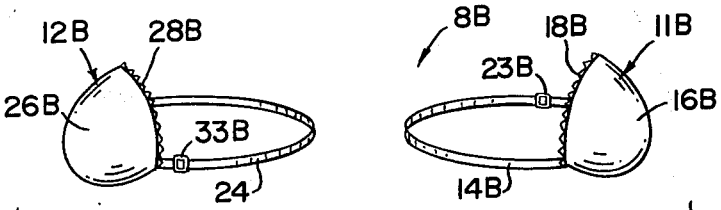
FIG. 6

MASTECTOMY BRA

BACKGROUND OF THE INVENTION

1. Field of the Invention

This invention relates to wearing apparel and more particularly, to a bra specifically adapted for a female with only one breast.

2. Description of the Prior Art

Statistics of the American Cancer Society reveal that an alarming number of mastectomy operations are performed in this country every year. Presently, there are several different types of mastectomy operations. In general, one of the female's breasts and possibly substantial adjacent tissue is removed in order to insure the complete removal of all malignant cells from the female. Accordingly, the woman is left with a single breast remaining after the mastectomy operation. Although various types of plastic surgery is now available to mastectomy patients, the overwhelming majority of mastectomy patients adopt the use of a prosthesis which is worn in place of the removed breast.

A substantial amount of psychological and emotional discomfort is encountered by a woman subsequent to a mastectomy operation. This emotional discomfort is most severe when the female engages in sexual activity. In general, the female wears a conventional brassiere with the prosthesis in place of the removed breast. At the time of sexual encounter, the female has several alternatives, each of which is unsatisfactory for both the female and her partner. The first alternative is to leave the bra on during the sexual activity. This alternative is unsatisfactory for obvious reasons. The second alternative is to partially remove the bra to expose only the remaining breast. This is unsatisfactory since the female and her partner are encumbered by the presence of the brassiere. The third alternative is to remove the bra and the prosthesis, thereby exposing an unsightly scar and a flat chest. In all of the alternatives, the psychological and emotional discomfort is exaggerated and, in general, destroys the mood and attitude of both parties.

Therefore it is an object of this invention to provide an apparatus which overcomes the aforementioned inadequacies of the prior art devices and provides an improvement which is a significant contribution to the advancement of the wearing apparel art.

Another object of this invention is to provide a bra specifically adapted for a female having a single breast comprising a left and a right bra element each being an independent and separate article wherein one of the bra elements can be completely removed to expose the breast of the female while simultaneously enabling the other of the bra elements to remain in place over the prosthesis of the female.

Another object of this invention is to provide a bra specifically adapted for a female having a single breast comprising left and right independent bra elements, each of which may be independently removed and wherein each of the left and right bra elements may be fashioned in the latest fashion and style of conventional bras.

Another object of this invention is to provide a bra specifically adapted for a female having a single breast wherein each of the left and right bra elements is an independent and separate article for forming a composite bra which looks and appears as a conventional two-cup bra.

Another object of this invention is to provide a bra specifically adapted for a female having a single breast which will aid in the emotional and psychological well-being of both the female and her partner during sexual activity.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention may be incorporated into a bra for a female having a single breast. The bra comprises a left and a right bra element with each element being an independent and separate article. Each of the left and right bra elements comprises a bra cup and a chest band secured to the bra cup for encircling the chest of the female. A bra clasp is disposed in at least one of the chest bands enabling only one of the bra elements to be removed to expose the breast of the female while simultaneously enabling the other of the bra elements to remain in place to cover the prosthesis of the female.

In a more specific embodiment of the invention, the left bra element comprises a left chest band made of an elastic material and secured to the underside of the left bra cup. The left shoulder strap is integral with and extends from the left bra cup to the left chest band for supporting the left breast of the female or the prosthesis. In a similar manner, the right chest band is made of an elastic material and is secured to the underside of the right bra cup. The right shoulder strap is integral with and extends between the right bra cup and the right chest band for supporting the right breast of the female or the prosthesis. It should be appreciated that in this embodiment, the bra is in the form of a strap-type of a bra, whereas in the broad concept of the invention, the bra may be either a strap or a strapless type bra.

The bra clasp is preferably disposed in the front portion of the chest band. Each of the right and left chest bands is preferably made of a thin elastic material whereby the plural chest band extend about the back of the female and appear as a single conventional chest band. The left and the right shoulder straps are preferably adjustable in length to accommodate for the size of the female. In one specific embodiment of the invention, both the left and right chest bands incorporate a left and a right bra clasp respectively. Each of the left and right bra clasps are disposed in the front portion of the left and right chest bands. Accordingly, the left and right bra clasps are disposed immediately adjacent one another when the left and right bra elements are in proper position. It should be appreciated that the invention may appear with a single bra clasp with the other bra element having an unsevered, completely elastic chest band for securing the prosthesis therein.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 1 is a front elevational view of a female wearing an improved mastectomy bra;

FIG. 2 is a rear view of a female wearing the improved mastectomy bra;

FIG. 3 is an elevational view showing a left and a right bra element of the mastectomy bra shown in FIG. 1;

FIG. 4 is a side elevational view of the right bra element shown in FIG. 3;

FIG. 5 is a elevational view of a second embodiment of a left and a right bra element; and FIG. 6 is a third embodiment of a left and a right bra element in accordance with this invention.

Similar reference characters refer to similar parts throughout the several views of the drawings.

DETAILED DISCUSSION

FIGS. 1–4 illustrate a first embodiment of an improved bra 8 specifically designed for a female 10 having a single breast remaining after a mastectomy operation. The bra 8 comprises a left bra element 11 and a right bra element 12 shown as independent and separate articles in FIG. 3. The left bra element 11 comprises a left chest band 14 preferably made of a thin, completely elastic material. The left chest band 14 is permanently secured to the bottom edge of a left bra cup 16 preferably having a decorative lace trim 18 or the like. A left shoulder strap 20 is permanently secured to the upper edge of the left bra cup 16 and is likewise permanently secured to the chest band 14 as shown. An adjustable tab 22 is provided for adjusting the length of the left shoulder strap 20 in accordance with the size of the female. In this embodiment, a left clasp 23 is shown disposed in the front portion of the left chest band 14.

In a similar manner, a right chest band 24 is permanently secured to the bottom edge of a right bra cup 26 preferably having decorative lace trim 28 and the like. A right shoulder strap 30 extends from the upper edge of the right bra cup 26 to be permanently secured to the right chest band 24. An adjustment tab 32 is similarly disposed in the right shoulder strap 30 for adjusting for the size of the female. FIG. 4 illustrates a side elevational view of the right bra element 12 shown in FIGS. 1 and 3. The left and right bra elements 11 and 12 are identical in all other respects.

FIG. 1 illustrates the bra 8 disposed on the female 10 with both the left and right bra elements 11 and 12 in place. The left and right clasps 23 and 33 are disposed in front portion of the respective left and right chest bands 14 and 24 and immediately adjacent one another. One of the bra cups 16 and 26 supports the breast of the female whereas the other of the bra cups 16 and 26 supports the prosthesis. Removal of one of the clasps 23 and 33, enables one of the right and left bra elements 11 and 12 to be completely removed exposing the breast while the other of the right and left bra elements 11 and 12 remains in place to maintain the prosthesis in the proper position. It should be appreciated that the remaining chest band is of a narrow elastic nature which will not interfere with the exposed breast.

It should also be appreciated that the bra as disclosed is of a delicate nature and is distinguished from a partially removable cup of a nursing bra or the like. Nursing bras are specifically designed to expose only a nipple of the female while providing support for the breast. Such a bra is completely unsuitable for the intent and purpose of the instant invention. It is a specific intention of the instant invention to provide a bra which overcomes the psychological and emotional difficulties encountered by a female after a mastectomy operation. The instant invention has been found to be extremely valuable for this intended purpose and use.

FIG. 5 illustrates a modification of the invention shown in FIGS. 1–4 with similar structural elements being labeled with similar reference numerals followed by an A. In this embodiment, the left and right bra elements 11A and 12A are specifically designed for the left bra element 11A to support the prosthesis and for the right bra element 12A to support the breast of the female. In this embodiment, the left chest band 14A is made of an endless elastic material void of any clasps or connecting devices. The shoulder strap 20A contains an adjustment 22A in a manner similar to FIG. 3. The right chest band 24A contains a clasp 33A for easy removal. In this embodiment, the left bra element 11A cannot be easily removed due to an absence of a clasp. Accordingly, the single clasp 33A insures that the proper bra element is removed to expose the breast of the female. It should also be appreciated that the shoulder strap adjustment 22A and 32A shown in FIGS. 1–5 may be eliminated by the use of an elastic material.

An optional interbra clasp 34 comprises a hook 36 secured to the right bra cup 12A and a loop 38 secured to the left bra cup 11A. The interbra clasp 34 aids in the positioning of the left and right bra cups 11A and 12A relative to one another. It should be understood that the interbra clasp 34 is optional and may be utilized on any of the embodiments dislosed herein.

FIG. 6 illustrates still a further embodiment of the invention with similar structural elements being labeled with similar reference numerals followed by a B. In this embodiment, the left and right bra elements 11B and 12B comprise strapless chest bands 14B and 24B. The left chest band 14B comprises a left clasp 23B which is disposed in the rear portion of the chest band 14B. The right bra element 12B comprises a right clasp 33B disposed in the front portion of the right chest band 24B. Accordingly, the spacing of the left and right clasps 23B and 33B, insures the proper removal of one of the left and right bra elements. It should also be appreciated that the embodiments shown in FIGS. 1–4 and 6 are adapatable for a female having a left or right mastectomy operation. The embodiment shown in FIG. 5 is specifically designed for a female having a left mastectomy operation.

In the embodiment shown in FIGS. 1–5, the clasps were preferably shown in the front portion of the chest bands. In many cases, a mastectomy female encounters difficulty in clasping a bra having a clasp disposed in the rear portion of the chest band. Other females encounter little or no difficulty in fastening a rear clasp bra. Accordingly, the embodiments shown in FIGS. 1–6 find various applications for the community.

The foregoing has disclosed a bra specifically adapted for a female having a single breast. It should be appreciated that the bra was specifically designed to aid in exposing the natural breast of the female during sexual activity for reducing the psychological or emotional difficulties encounted by the use of a conventional bra. It should also be appreciated that the entire intent and purpose, structure and function of this invention is entirely distinct from the well known nursing bras having a removable cup element.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

What is claimed is:

1. A bra specifically adapted for a female having a single breast, comprising in combination:

a left bra element comprising:

a left bra cup specifically designed for receiving the left breast of the female or a prosthesis, a left chest band secured to said left bra cup for encircling the chest of the female, a left shoulder strap secured between said left bra cup and said left chest band for extending across the left shoulder of the female for supporting said left bra cup, a right bra element comprising;

a right bra cup specifically designed for receiving the right breast of the female or a prosthesis, a right chest band secured to said right bra cup for encircling the chest of the female, a right shoulder strap secured between said right bra cup and said right chest band for extending across the right shoulder of the female for supporting said right bra cup, a bra clasp disposed in at least one of said left and said right chest bands for removably securing one of said left and said right chest bands about the chest of the female;

said left bra element being independent of said right bra element enabling one of said left or right bra cups to be removed to expose the breast of the female while simultaneously enabling the other of said left or right bra cups to remain in place to cover the prosthesis of the female; and each of said left and right chest bands being a thin elastic material whereby the plural chest bands extending about the back of the female appear as a single conventional chest band.

2. A bra as set forth in claim 1, wherein said bra clasp is disposed in the front portion of said chest band.

3. A bra as set forth in claim 1, wherein each of said left and right chest bands is permanently secured to said left and right bra cups respectively.

4. A bra as set forth in claim 1, including a left and a right bra clasp disposed in the front portion of said left and right chest bands respectively; and said left and right bra clasps being disposed immediately adjacent one another when said left and right bra elements are in proper position.

5. A bra for a female having the absence of a single breast, comprising in combination:

a left bra element comprising a left bra cup;

a left chest band made of an elastic material and secured to the underside of said left bra cup;

a left shoulder strap integral with and extending between said left bra cup and said left chest band for supporting the left breast of the female or a prosthesis;

a right bra element comprising a right bra cup;

a right chest band made of an elastic material and secured to the underside of said right bra cup;

a right shoulder strap integral with and extending between said right bra cup and said right chest band for supporting the right breast of the female or a prosthesis;

the left bra element being a separate article from the right bra element enabling either of said left or right bra elements to be removed while simultaneously enabling the other of said left and right bra elements to remain in place; and a bra clasp being disposed in only one of said left and right chest bands with the other of said left and right chest bands being void of a bra clasp enabling speedy removal of the clasp to remove only the bra element containing the breast of the female.

* * * * *